US007234249B2

(12) United States Patent
Ellis, III

(10) Patent No.: US 7,234,249 B2
(45) Date of Patent: Jun. 26, 2007

(54) SHOE SOLE STRUCTURES

(75) Inventor: Frampton E. Ellis, III, Jasper, FL (US)

(73) Assignee: Anatomic Reseach, Inc., Jasper, FL (US)

( * ) Notice: Subject to any disclaimer, the term of this patent is extended or adjusted under 35 U.S.C. 154(b) by 0 days.

(21) Appl. No.: 10/994,746

(22) Filed: Nov. 22, 2004

(65) Prior Publication Data

US 2005/0086837 A1 Apr. 28, 2005

Related U.S. Application Data

(60) Division of application No. 10/320,353, filed on Dec. 16, 2002, now abandoned, which is a continuation of application No. 08/033,468, filed on Mar. 18, 1993, now Pat. No. 6,584,706, which is a continuation of application No. 07/463,302, filed on Jan. 10, 1990, now abandoned.

(51) Int. Cl.
*A43B 13/18* (2006.01)

(52) U.S. Cl. ..... 36/25 R; 36/29

(58) Field of Classification Search ..... 36/28, 36/29, 25 R

See application file for complete search history.

(56) References Cited

U.S. PATENT DOCUMENTS

| | | | |
|---|---|---|---|
| 288,127 | A | 11/1883 | Shepard |
| 1,458,446 | A | 6/1923 | Shaeffer |
| 1,639,381 | A | 9/1927 | Manelas |
| 2,147,197 | A | 2/1939 | Glidden |
| 2,328,242 | A | 8/1943 | Witherill |

(Continued)

FOREIGN PATENT DOCUMENTS

| | | |
|---|---|---|
| AT | 200 963 | 5/1958 |

(Continued)

OTHER PUBLICATIONS

Case Alumnus, Fall 1989, pp. 5-6.
Runner's World, Jun. 1989, p. 56.
Frederick, E.C., "*Sports Shoes and Playing Surfaces*" pp. 32-35 and 46.
Blechschmidt, E., "*The Structure of the Calcaneal Padding*", Foot and Ankle, Mar. 1982, pp. 260-293.
Cavanaugh, P., "*The Running Shoe Book*", pp. 176-180, DK.

*Primary Examiner*—Marie Patterson
(74) *Attorney, Agent, or Firm*—Knoble Yoshida & Dunleavy, LLC

(57) ABSTRACT

A shoe having an anthropomorphic sole that copies the underlying stability, support, and cushioning structures of the human foot. Natural stability is provided by attaching a completely flexible but relatively inelastic shoe sole upper directly to the bottom sole, enveloping the sides of the midsole, instead of attaching it to the top surface of the shoe sole. Doing so puts the flexible side of the shoe upper under tension in reaction to destabilizing sideways forces on the shoe causing it to tilt. That tension force is balanced and in equilibrium because the bottom sole is firmly anchored by body weight, so the destabilizing sideways motion is neutralized by the tension in the flexible sides of the shoe upper. Support and cushioning is provided by shoe sole compartments filled with a pressure-transmitting medium like liquid, gas, or gel. Unlike similar existing systems, direct physical contact occurs between the upper surface and the lower surface of the compartments, providing firm, stable support. Cushioning is provided by the transmitting medium progressively causing tension in the flexible and semi-elastic sides of the shoe sole. The support and cushioning compartments are similar in structure to the fat pads of the human foot, which simultaneously provide both firm support and progressive cushioning.

33 Claims, 6 Drawing Sheets

U.S. PATENT DOCUMENTS

| | | | |
|---|---|---|---|
| 2,433,329 | A | 12/1947 | Adler et al. |
| 2,434,770 | A | 1/1948 | Lutey |
| 2,627,676 | A | 2/1953 | Hack |
| 3,110,971 | A | 11/1963 | Chang |
| 3,512,274 | A | 5/1970 | McGrath |
| 3,535,799 | A | 10/1970 | Onitsvka |
| 4,030,213 | A | 6/1977 | Daswick |
| 4,170,078 | A | 10/1979 | Moss |
| 4,183,156 | A | 1/1980 | Rudy |
| 4,219,945 | A | 9/1980 | Rudy |
| 4,223,457 | A | 9/1980 | Borgeas |
| 4,227,320 | A | 10/1980 | Borgeas |
| 4,266,349 | A | 5/1981 | Schmohl |
| 4,268,980 | A | 5/1981 | Coomer |
| 4,271,606 | A | 6/1981 | Rudy |
| 4,316,332 | A | 2/1982 | Giese et al. |
| 4,319,412 | A | 3/1982 | Muller et al. |
| 4,340,626 | A | 7/1982 | Rudy |
| 4,348,821 | A | 9/1982 | Daswick |
| 4,354,319 | A | 10/1982 | Block et al. |
| 4,370,817 | A | 2/1983 | Ratanangsu |
| 4,449,306 | A | 5/1984 | Cavanagh |
| 4,455,767 | A | 6/1984 | Bergmans |
| 4,484,397 | A | 11/1984 | Curley, Jr. |
| 4,521,979 | A | 6/1985 | Blaser |
| 4,527,345 | A | 7/1985 | Lopez Lopez |
| 4,542,598 | A | 9/1985 | Misevich et al. |
| 4,557,059 | A | 12/1985 | Misevich et al. |
| 4,559,723 | A | 12/1985 | Hamy et al. |
| 4,559,724 | A | 12/1985 | Norton |
| 4,577,417 | A | 3/1986 | Cole |
| 4,624,062 | A | 11/1986 | Autry |
| 4,642,917 | A | 2/1987 | Ungar |
| 4,697,361 | A | 10/1987 | Ganter et al. |
| 4,715,133 | A | 12/1987 | Hartjes et al. |
| 4,748,753 | A | 6/1988 | Ju |
| 4,756,098 | A | 7/1988 | Boggia |
| 4,768,295 | A | 9/1988 | Ito |
| 4,817,304 | A | 4/1989 | Parker et al. |
| 4,833,795 | A | 5/1989 | Diaz |
| 4,858,340 | A | 8/1989 | Pasternak |
| 4,934,073 | A | 6/1990 | Robinson |
| 4,982,737 | A | 1/1991 | Guttmann |
| D315,634 | S | 3/1991 | Yung-Mao |
| 5,077,916 | A | 1/1992 | Beneteau |
| 5,317,819 | A | 6/1994 | Ellis, III |

FOREIGN PATENT DOCUMENTS

| | | |
|---|---|---|
| CA | 1176458 | 10/1984 |
| DE | 1287477 | 1/1969 |
| DE | 1290844 | 3/1969 |
| DK | 8800008 | 1/1988 |
| EP | 0 215 974 | 4/1987 |
| EP | 0 215974 | 4/1987 |
| FR | 1323455 | 6/1962 |
| FR | 2006270 | 11/1971 |
| FR | 2261721 | 9/1975 |
| WO | WO 87/07480 | 12/1987 |

UNLOADED, UPRIGHT

LOADED MODERATELY, UPRIGHT

LOADED HEAVILY, UPRIGHT

LOADED HEAVILY, 20° LATERAL TILT

SHOE SOLE STRUCTURES

RELATED APPLICATION DATA

This application is a divisional of U.S. patent application Ser. No. 10/320,353, filed on Dec. 16, 2002 abandoned; which, in turn, is a continuation of U.S. patent application Ser. No. 08/033,468, filed Mar. 18, 1993, now U.S. Pat. No. 6,584,706; which, in turn, is a continuation of U.S. patent application Ser. No. 07/463,302, filed Jan. 10, 1990, now abandoned.

BACKGROUND OF THE INVENTION

This invention relates generally to the structure of shoes. More specifically, this invention relates to the structure of athletic shoes. Still more particularly, this invention relates to a shoe having an anthropomorphic sole that copies the underlying support, stability and cushioning structures of the human foot. Natural stability is provided by attaching a completely flexible but relatively inelastic shoe sole upper directly to the bottom sole, enveloping the sides of the midsole, instead of attaching it to the top surface of the shoe sole. Doing so puts the flexible side of the shoe upper under tension in reaction to destabilizing sideways forces on the shoe causing it to tilt. That tension force is balanced and in equilibrium because the bottom sole is firmly anchored by body weight, so the destabilizing sideways motion is neutralized by the tension in the flexible sides of the shoe upper.

Still more particularly, this invention relates to support and cushioning which is provided by shoe sole compartments filled with a pressure-transmitting medium like liquid, gas, or gel. Unlike similar existing systems, direct physical contact occurs between the upper surface and the lower surface of the compartments, providing firm, stable support. Cushioning is provided by the transmitting medium progressively causing tension in the flexible and semi-elastic sides of the shoe sole. The compartments providing support and cushioning are similar in structure to the fat pads of the foot, which simultaneously provide both firm support and progressive cushioning.

Existing cushioning systems cannot provide both firm support and progressive cushioning without also obstructing the natural pronation and supination motion of the foot, because the overall conception on which they are based is inherently flawed. The two most commercially successful proprietary systems are Nike Air, based on U.S. Pat. No. 4,219,945 issued Sep. 2, 1980, U.S. Pat. No. 4,183,156 issued Sep. 15, 1980, U.S. Pat. No. 4,271,606 issued Jun. 9, 1981, and U.S. Pat. No. 4,340,626 issued Jul. 20, 1982; and Asics Gel, based on U.S. Pat. No. 4,768,295 issued Sep. 6, 1988. Both of these cushioning systems and all of the other less popular ones have two essential flaws.

First, all such systems suspend the upper surface of the shoe sole directly under the important structural elements of the foot, particularly the critical the heel bone, known as the calcaneus, in order to cushion it. That is, to provide good cushioning and energy return, all such systems support the foot's bone structures in buoyant manner, as if floating on a water bed or bouncing on a trampoline. None provide firm, direct structural support to those foot support structures; the shoe sole surface above the cushioning system never comes in contact with the lower shoe sole surface under routine loads, like normal weight-bearing. In existing cushioning systems, firm structural support directly under the calcaneus and progressive cushioning are mutually incompatible. In marked contrast, it is obvious with the simplest tests that the barefoot is provided by very firm direct structural support by the fat pads underneath the bones contacting the sole, while at the same time it is effectively cushioned, though this property is underdeveloped in habitually shoe shod feet.

Second, because such existing proprietary cushioning systems do not provide adequate control of foot motion or stability, they are generally augmented with rigid structures on the sides of the shoe uppers and the shoe soles, like heel counters and motion control devices, in order to provide control and stability. Unfortunately, these rigid structures seriously obstruct natural pronation and supination motion and actually increase lateral instability, as noted in the applicant's pending U.S. application Ser. No. 07/219,387, filed on Jul. 15, 1988; Ser. No. 07/239,667, filed on Sep. 2, 1988; Ser. No. 07/400,714, filed on Aug. 30, 1989; Ser. No. 07/416,478, filed on Oct. 3, 1989; and Ser. No. 07/424,509, filed on Oct. 20, 1989, as well as in PCT Application No. PCT/US89/03076 filed on Jul. 14, 1989. The purpose of the inventions disclosed in these applications was primarily to provide a neutral design that allows for natural foot and ankle biomechanics as close as possible to that between the foot and the ground, and to avoid the serious interference with natural foot and ankle biomechanics inherent in existing shoes.

In marked contrast to the rigid-sided proprietary designs discussed above, the barefoot provides stability at it sides by putting those sides, which are flexible and relatively inelastic, under extreme tension caused by the pressure of the compressed fat pads; they thereby become temporarily rigid when outside forces make that rigidity appropriate, producing none of the destabilizing lever arm torque problems of the permanently rigid sides of existing designs.

The applicant's new invention simply attempts, as closely as possible, to replicate the naturally effective structures of the foot that provide stability, support, and cushioning.

Accordingly, it is a general object of this invention to elaborate upon the application of the principle of the natural basis for the support, stability and cushioning of the barefoot to shoe structures.

It is still another object of this invention to provide a shoe having a sole with natural stability provided by attaching a completely flexible but relatively inelastic shoe sole upper directly to the bottom sole, enveloping the sides of the midsole, to put the side of the shoe upper under tension in reaction to destabilizing sideways forces on a tilting shoe.

It is still another object of this invention to have that tension force is balanced and in equilibrium because the bottom sole is firmly anchored by body weight, so the destabilizing sideways motion is neutralized by the tension in the sides of the shoe upper.

It is another object of this invention to create a shoe sole with support and cushioning which is provided by shoe sole compartments, filled with a pressure-transmitting medium like liquid, gas, or gel, that are similar in structure to the fat pads of the foot, which simultaneously provide both firm support and progressive cushioning.

These and other objects of the invention will become apparent from a detailed description of the invention which follows taken with the accompanying drawings.

BRIEF DESCRIPTION OF THE DRAWINGS

FIG. 8 is a sequential series of frontal plane cross sections of the barefoot heel at the ankle joint area.

FIG. 10 is two perspective views and a close-up view of the structure of fibrous connective tissue of the groups of fat cells of the human heel.

DETAILED DESCRIPTION OF THE PREFERRED EMBODIMENTS

Figure 1:
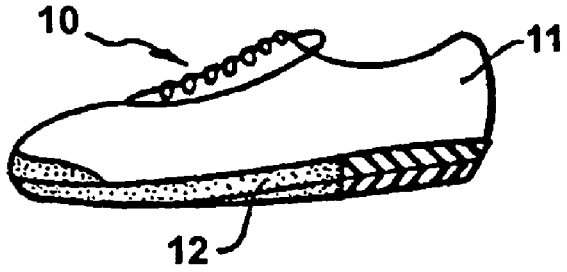
FIG. 1 (PRIOR ART)
FIG. 1 is a perspective view of a typical athletic shoe for running known to the prior art to which the invention is applicable.

FIG. 1 shows a perspective view of a shoe, such as a typical athletic shoe specifically for running, according to the prior art, wherein the running shoe 20 includes an upper portion 21 and a sole 22.

Figure 2:
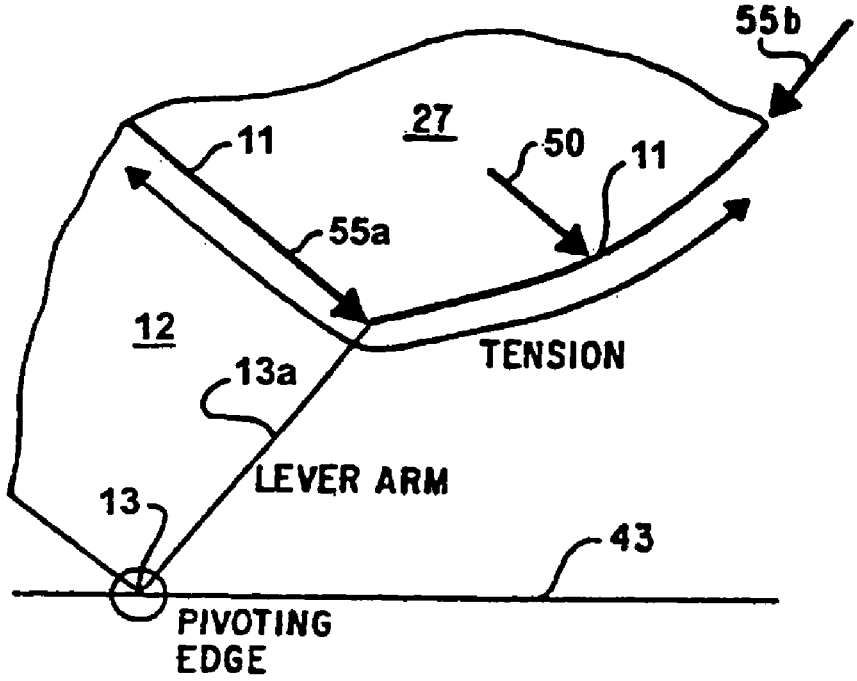
FIG. 2 (PRIOR ART)
FIG. 2 illustrates in a close-up frontal plane cross section of the heel at the ankle joint the typical shoe of existing art, undeformed by body weight, when tilted sideways on the bottom edge.
Figure 5A:
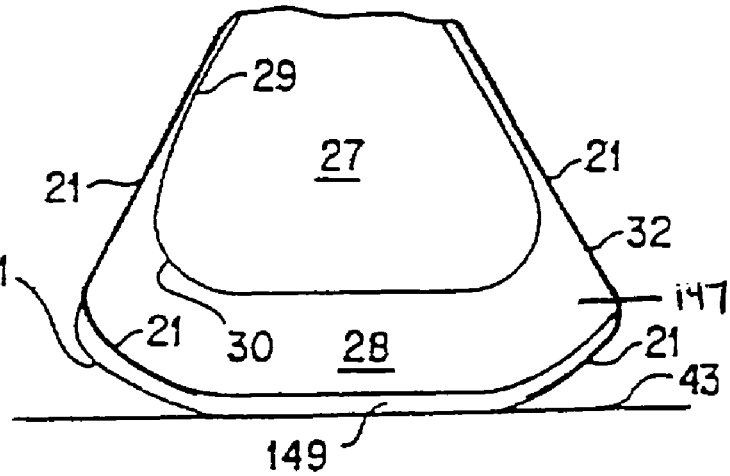
FIGS. 5A and 5B shows, in a frontal plane cross section at the ankle joint area of the heel, the applicant's new invention of tension stabilized sides applied to his prior naturally contoured shoe sole.

FIG. 2 illustrates, in a close-up cross section of a typical shoe of existing art (undeformed by body weight) on the ground 43 when tilted on the bottom outside edge 23 of the shoe sole 22, that an inherent stability problem remains in existing designs, even when the abnormal torque producing rigid heel counter and other motion devices are removed, as illustrated in FIG. 5 of pending U.S. application Ser. No. 07/400,714, filed on Aug. 30, 1989. The problem is that the remaining shoe upper 21 (shown in the thickened and darkened line), while providing no lever arm extension, since it is flexible instead of rigid, nonetheless creates unnatural destabilizing torque on the shoe sole. The torque is due to the tension force 155*a* along the top surface of the shoe sole 22 caused by a compression force 150 (a composite of the force of gravity on the body and a sideways motion force) to the side by the foot 27, due simply to the shoe being tilted to the side, for example. The resulting destabilizing force acts to pull the shoe sole in rotation around a lever arm 23*a* that is the width of the shoe sole at the edge. Roughly speaking, the force of the foot on the shoe upper pulls the shoe over on its side when the shoe is tilted sideways. The compression force 150 also creates a tension force 155*b*, which is the mirror image of tension force 155*a*.

Figure 3:
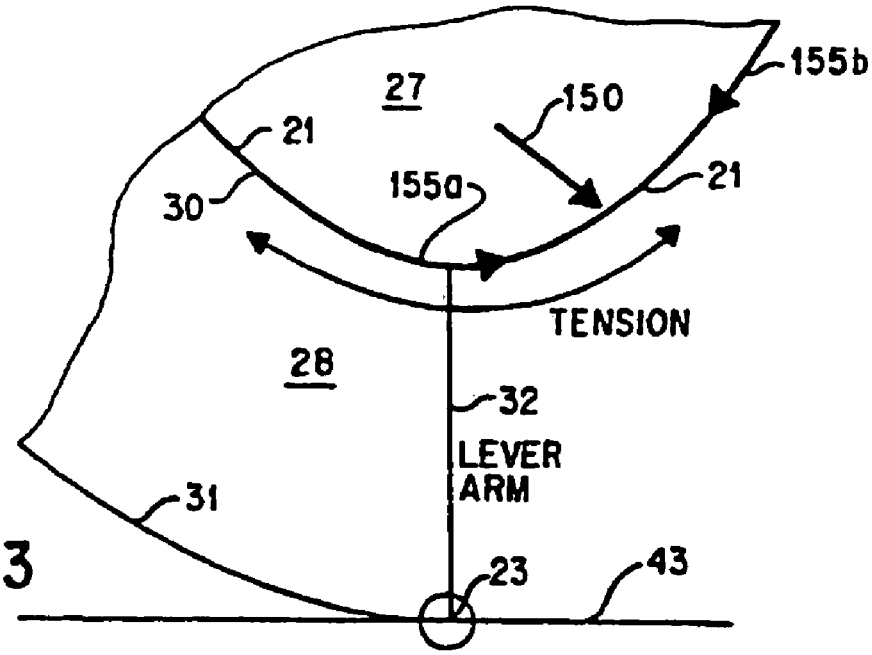
FIG. 3 shows, in the same close-up cross section as FIG. 2, the applicant's prior invention of a naturally contoured shoe sole design, also tilted out.

FIG. 3 shows, in a close-up cross section of a naturally contoured design shoe sole 28, described in pending U.S. application Ser. No. 07/239,667, filed on Sep. 2, 1988, (also shown undeformed by body weight) when tilted on the bottom edge, that the same inherent stability problem remains in the naturally contoured shoe sole design, though to a reduced degree. The problem is less since the direction of the force vector 155 along the lower surface of the shoe upper 21 is parallel to the ground 43 at the outer sole edge 32 edge, instead of angled toward the ground as in a conventional design like that shown in FIG. 2, so the resulting torque produced by lever arm created by the outer sole edge 32 would be less, and the contoured shoe sole 28 provides direct structural support when tilted, unlike conventional designs.

Figure 4:
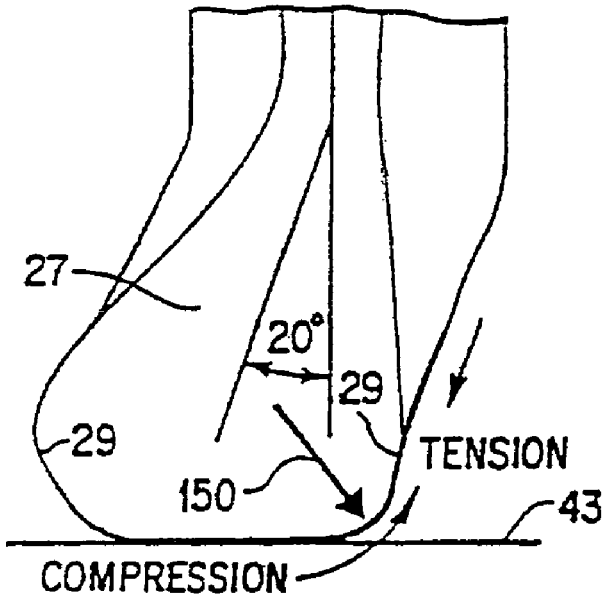
FIG. 4 shows a rear view of a barefoot heel tilted laterally 20 degrees.

FIG. 4 shows (in a rear view) that, in contrast, the barefoot is naturally stable because, when deformed by body weight and tilted to its natural lateral limit of about 20 degrees, it does not create any destabilizing torque due to tension force. Even though tension paralleling that on the shoe upper is created on the outer surface 29, both bottom and sides, of the bare foot by the compression force of weight-bearing, no destabilizing torque is created because the lower surface under tension (ie the foot's bottom sole, shown in the darkened line) is resting directly in contact with the ground. Consequently, there is no unnatural lever arm artificially created against which to pull. The weight of the body firmly anchors the outer surface of the foot underneath the foot so that even considerable pressure against the outer surface 29 of the side of the foot results in no destabilizing motion. When the foot is tilted, the supporting structures of the foot, like the calcaneus, slide against the side of the strong but flexible outer surface of the foot and create very substantial pressure on that outer surface at the sides of the foot. But that pressure is precisely resisted and balanced by tension along the outer surface of the foot, resulting in a stable equilibrium.

Figure 5B:
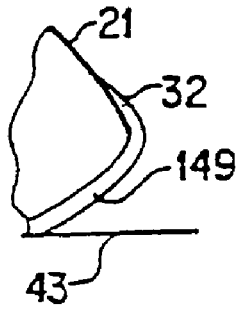

FIG. 5 shows, in cross section of the upright heel deformed by body weight, the principle of the tension stabilized sides of the barefoot applied to the naturally contoured shoe sole design; the same principle can be applied to conventional shoes, but is not shown. The key change from the existing art of shoes is that the sides of the shoe upper 21 (shown as darkened lines) must wrap around the outside edges 32 of the shoe sole 28, instead of attaching underneath the foot to the upper surface 30 of the shoe sole 28, as done conventionally. The shoe upper sides can overlap and be attached to either the inner 30 (shown on the left) or outer surface 31 (shown on the right) of the bottom sole 149, since those sides are not unusually load-bearing, as shown; or the bottom sole 149, optimally thin and tapering as shown, can extend upward around the outside edges 32 of the shoe sole 28 to overlap and attach to the shoe upper sides (shown FIG. 5B); their optimal position coincides with the Theoretically Ideal Stability Plane, so that the tension force on the shoe sides is transmitted directly all the way down to the bottom shoe, which anchors it on the ground with virtually no intervening artificial lever arm. For shoes with only one sole layer, the attachment of the shoe upper sides should be at or near the lower or bottom surface of the shoe sole.

The design shown in FIG. 5 is based on a fundamentally different conception: that the shoe upper is integrated into the shoe sole, instead of attached on top of it, and the shoe sole is treated as a natural extension of the foot sole, not attached to it separately.

The fabric (or other flexible material, like leather) of the shoe uppers would preferably be non-stretch or relatively so, so as not to be deformed excessively by the tension place upon its sides when compressed as the foot and shoe tilt. The fabric can be reinforced in areas of particularly high tension, like the essential structural support and propulsion elements defined in the applicant's earlier applications (the base and lateral tuberosity of the calcaneus, the base of the fifth metatarsal, the heads of the metatarsals, and the first distal phalange; the reinforcement can take many forms, such as like that of corners of the jib sail of a racing sailboat or more simple straps. As closely as possible, it should have the same performance characteristics as the heavily calloused skin of the sole of an habitually bare foot. The relative density of the shoe sole is preferred as indicated in FIG. 9 of pending U.S. application Ser. No. 07/400,714, filed on Aug. 30, 1989, with the softest density nearest the foot sole, so that the conforming sides of the shoe sole do not provide a rigid destabilizing lever arm.

The change from existing art of the tension stabilized sides shown in FIG. 5 is that the shoe upper is directly integrated functionally with the shoe sole, instead of simply being attached on top of it. The advantage of the tension stabilized sides design is that it provides natural stability as close to that of the barefoot as possible, and does so economically, with the minimum shoe sole side width possible.

Figure 6:
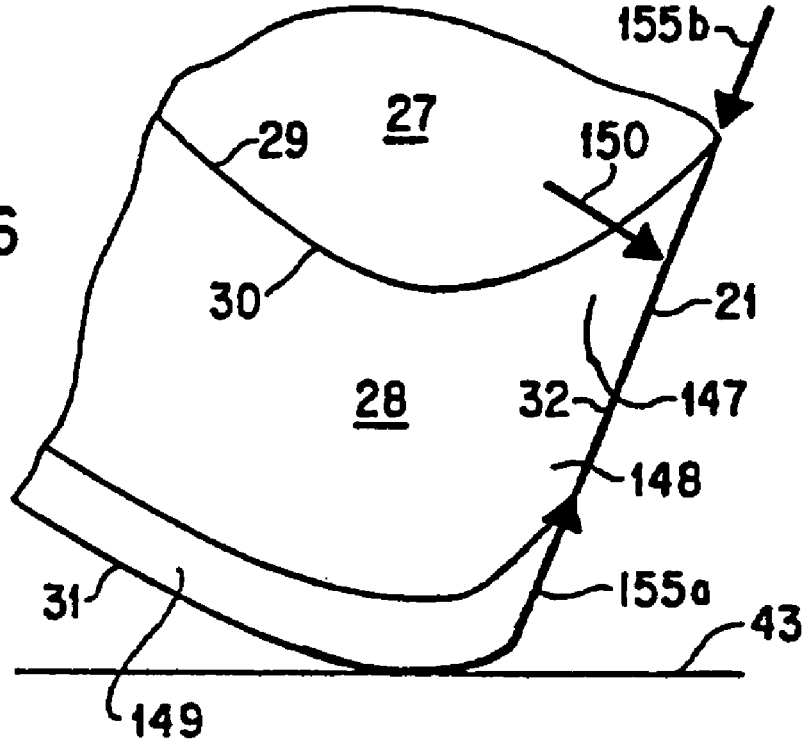
FIG. 6 shows, in a frontal plane cross section close-up, the FIG. 5 design when tilted to its edge, but undeformed by load.

The result is a shoe sole that is naturally stabilized in the same way that the barefoot is stabilized, as seen in FIG. 6, which shows a close-up cross section of a naturally contoured design shoe sole 28 (undeformed by body weight) when tilted to the edge. The same destabilizing force against the side of the shoe shown in FIG. 2 is now stably resisted by offsetting tension in the surface of the shoe upper 21 extended down the side of the shoe sole so that it is anchored by the weight of the body when the shoe and foot are tilted.

In order to avoid creating unnatural torque on the shoe sole, the shoe uppers may be joined or bonded only to the bottom sole, not the midsole, so that pressure shown on the side of the shoe upper produces side tension only and not the destabilizing torque from pulling similar to that described in FIG. 2. However, to avoid unnatural torque, the upper areas 147 of the shoe midsole, which forms a sharp corner, should be composed of relatively soft midsole material; in this case, bonding the shoe uppers to the midsole would not create very much destabilizing torque. The bottom sole is preferably thin, at least on the stability sides, so that its attachment overlap with the shoe upper sides coincide as close as possible to the Theoretically Ideal Stability Plane, so that force is transmitted on the outer shoe sole surface to the ground.

In summary, the FIG. 5 design is for a shoe construction, including: a shoe upper that is composed of material that is flexible and relatively inelastic at least where the shoe upper contacts the areas of the structural bone elements of the human foot, and a shoe sole that has relatively flexible sides; and at least a portion of the sides of the shoe upper being attached directly to the bottom sole, while enveloping on the outside the other sole portions of said shoe sole. This construction can either be applied to convention shoe sole structures or to the applicant's prior shoe sole inventions, such as the naturally contoured shoe sole conforming to the theoretically ideal stability plane.

Figure 7:
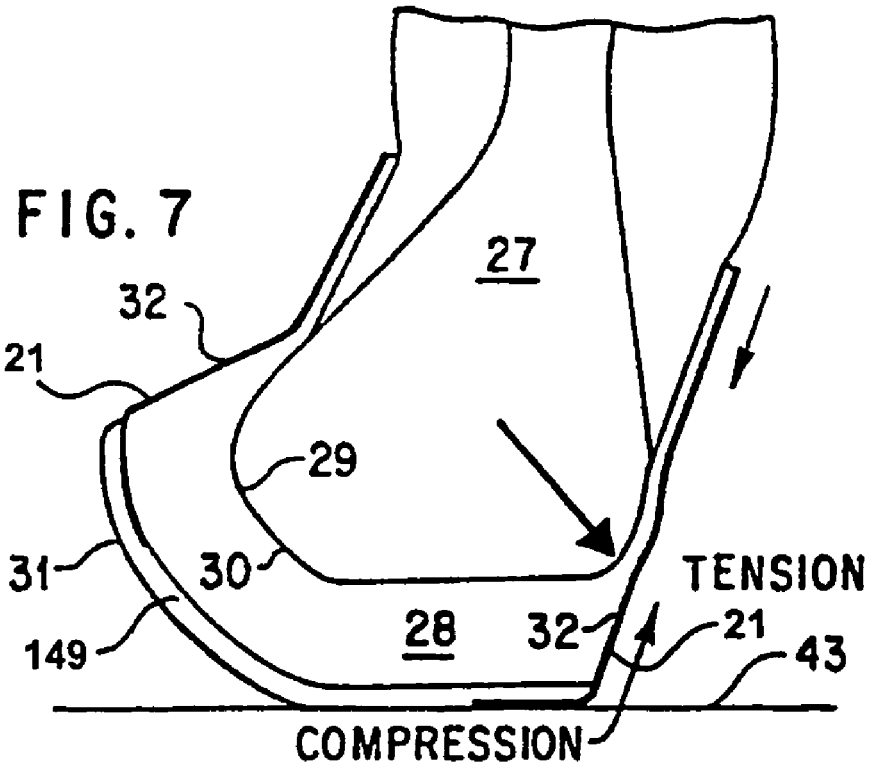
FIG. 7 shows, in frontal plane cross section at the ankle joint area of the heel, the FIG. 5 design when tilted to its edge and naturally deformed by body weight, though constant shoe sole thickness is maintained undeformed.

FIG. 7 shows, in cross section at the heel, the tension stabilized sides concept applied to naturally contoured design shoe sole when the shoe and foot are tilted out fully and naturally deformed by body weight (although constant shoe sole thickness is shown undeformed). The figure shows that the shape and stability function of the shoe sole and shoe uppers mirror almost exactly that of the human foot.

Figure 8A:
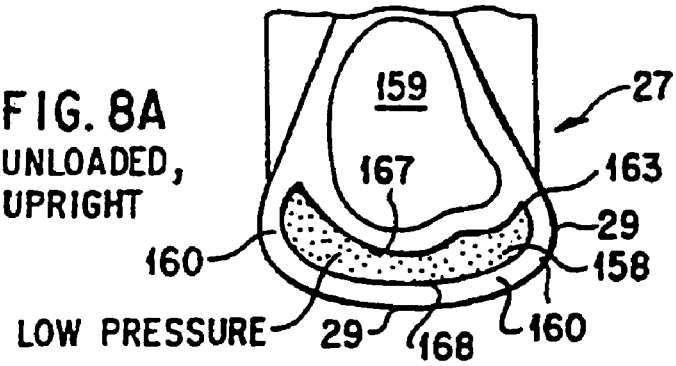
FIG. 8A is unloaded and upright.

FIGS. 8A–8D show the natural cushioning of the human barefoot, in cross sections at the heel. FIG. 8A shows the bare heel upright and unloaded, with little pressure on the subcalcaneal fat pad 158, which is evenly distributed between the calcaneus 159, which is the heel bone, and the bottom sole 160 of the foot.

Figure 8B:
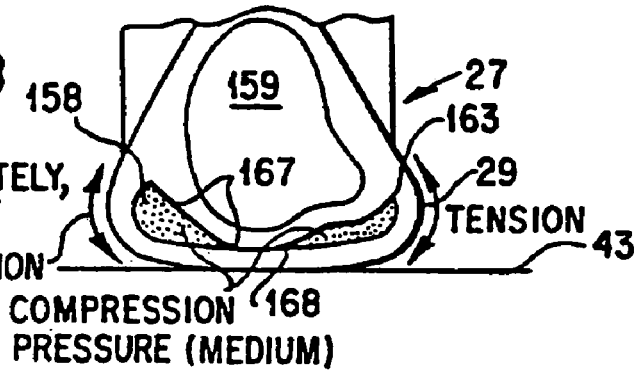
FIG. 8B is moderately loaded by full body weight and upright.

FIG. 8B shows the bare heel upright but under the moderate pressure of full body weight. The compression of the calcaneus against the subcalcaneal fat pad produces evenly balanced pressure within the subcalaneal fat pad because it is contained and surrounded by a relatively unstretchable fibrous capsule, the bottom sole of the foot. Underneath the foot, where the bottom sole is in direct contact with the ground, the pressure caused by the calcaneus on the compressed subcalcaneal fat pad is transmitted directly to the ground. Simultaneously, substantial tension is created on the sides of the bottom sole of the foot because of the surrounding relatively tough fibrous capsule. That combination of bottom pressure and side tension is the foot's natural shock absorption system for support structures like the calcaneus and the other bones of the foot that come in contact with the ground.

Of equal functional importance is that lower surface 167 of those support structures of the foot like the calcaneus and other bones make firm contact with the upper surface 168 of the foot's bottom sole underneath, with relatively little uncompressed fat pad intervening. In effect, the support structures of the foot land on the ground and are firmly supported; they are not suspended on top of springy material in a buoyant manner analogous to a water bed or pneumatic tire, like the existing proprietary shoe sole cushioning systems like Nike Air or Asics Gel. This simultaneously firm and yet cushioned support provided by the foot sole must have a significantly beneficial impact on energy efficiency, also called energy return, and is not paralleled by existing shoe designs to provide cushioning, all of which provide shock absorption cushioning during the landing and support phases of locomotion at the expense of firm support during the take-off phase.

Figure 8C:
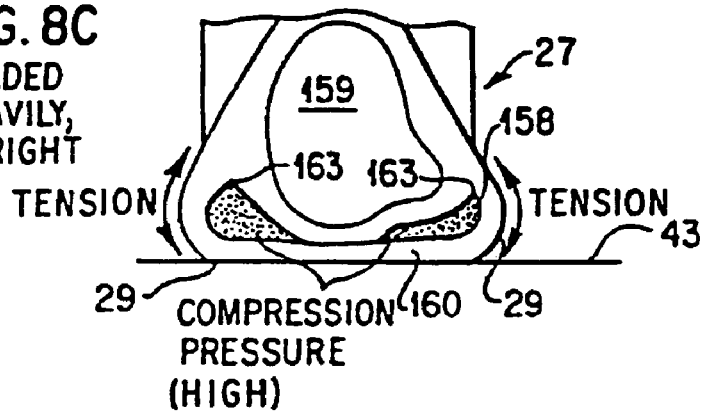
FIG. 8C is heavily loaded at peak landing force while running and upright.

The incredible and unique feature of the foot's natural system is that, once the calcaneus is in fairly direct contact with the bottom sole and therefore providing firm support and stability, increased pressure produces a more rigid fibrous capsule that protects the calcaneus and greater tension at the sides to absorb shock. So, in a sense, even when the foot's suspension system would seem in a conventional way to have bottomed out under normal body weight pressure, it continues to react with a mechanism to protect and cushion the foot even under very much more extreme pressure. This is seen in FIG. 8C, which shows the human heel under the heavy pressure of roughly three times body weight force of landing during routine running. This can be easily verified: when one stands barefoot on a hard floor, the heel feels very firmly supported and yet can be lifted and virtually slammed onto the floor with little increase in the feeling of firmness; the heel simply becomes harder as the pressure increases.

In addition, it should be noted that this system allows the relatively narrow base of the calcaneus to pivot from side to side freely in normal pronation/supination motion, without any obstructing torsion on it, despite the very much greater width of compressed foot sole providing protection and cushioning; this is crucially important in maintaining natural alignment of joints above the ankle joint such as the knee, hip and back, particularly in the horizontal plane, so that the entire body is properly adjusted to absorb shock correctly. In contrast, existing shoe sole designs, which are generally relatively wide to provide stability, produce unnatural frontal plane torsion on the calcaneus, restricting its natural motion, and causing misalignment of the joints operating above it, resulting in the overuse injuries unusually common with such shoes. Instead of flexible sides that harden under tension caused by pressure like that of the foot, existing shoe sole designs are forced by lack of other alternatives to use relatively rigid sides in an attempt to provide sufficient stability to offset the otherwise uncontrollable buoyancy and lack of firm support of air or gel cushions.

Figure 8D:
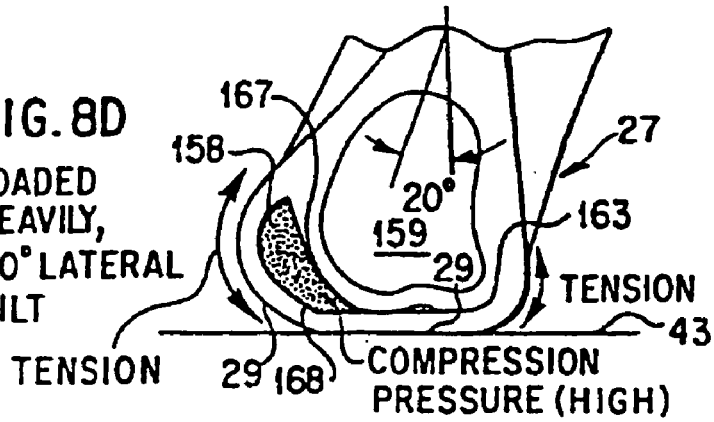
FIG. 8D is heavily loaded and tilted out laterally to its about 20 degree maximum.

FIG. 8D shows the barefoot deformed under full body weight and tilted laterally to the roughly 20 degree limit of normal range. Again it is clear that the natural system provides both firm lateral support and stability by providing relatively direct contact with the ground, while at the same time providing a cushioning mechanism through side tension and subcalcaneal fat pad pressure.

FIGS. 9A–9D show, also in cross sections at the heel, a naturally contoured shoe sole design that parallels as closely as possible the overall natural cushioning and stability system of the barefoot described in FIG. 8, including a cushioning compartment 161 under support structures of the foot containing a pressure-transmitting medium like gas, gel, or liquid, like the subcalcaneal fat pad under the calcaneus and other bones of the foot; consequently, FIGS. 9A–D directly correspond to FIGS. 8A–D. The optimal pressure-transmitting medium is that which most closely approximates the fat pads of the foot; silicone gel is probably most optimal of materials currently readily available, but future improvements are probable; since it transmits pressure indirectly, in that it compresses in volume under pressure, gas is significantly less optimal. The gas, gel, or liquid, or any other effective material, can be further encapsulated itself, in addition to the sides of the shoe sole, to control leakage and maintain uniformity, as is common conventionally, and can be subdivided into any practical number of encapsulated areas within a compartment, again as is common conventionally. The relative thickness of the cushioning compartment 161 can vary, as can the bottom sole 149 and the upper midsole 147, and can be consistent or differ in various areas of the shoe sole; the optimal relative sizes should be those that approximate most closely those of the average human foot, which suggests both smaller upper and lower soles and a larger cushioning compartment than shown in FIG. 9. And the cushioning compartments or pads 161 can be placed anywhere from directly underneath the foot, like an insole, to directly above the bottom sole. Optimally, the amount of compression created by a given load in any cushioning compartment 161 should be tuned to approximate as closely as possible the compression under the corresponding fat pad of the foot.

The function of the subcalcaneal fat pad is not met satisfactorily with existing proprietary cushioning systems, even those featuring gas, gel or liquid as a pressure transmitting medium. In contrast to those artificial systems, the new design shown is FIG. 9 conforms to the natural contour of the foot and to the natural method of transmitting bottom pressure into side tension in the flexible but relatively non-stretching (the actual optimal elasticity will require empirical studies) sides of the shoe sole.

Figure 9A:
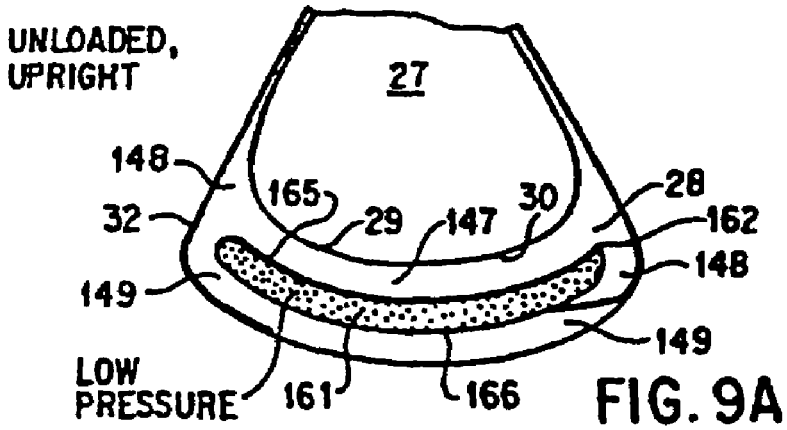
FIGS. 9A–9D is the applicant's new shoe sole design in a sequential series of frontal plane cross sections of the heel at the ankle joint area that corresponds exactly to the FIG. 8 series above.
Figure 9B:
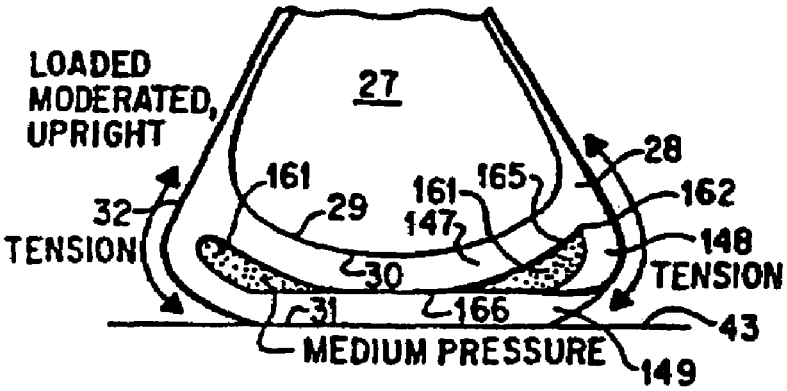
Figure 9C:
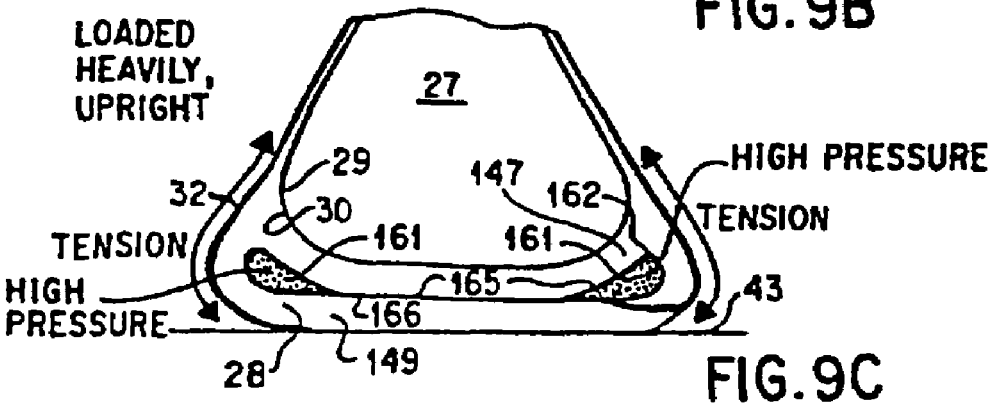

Existing cushioning systems like Nike Air or Asics Gel do not bottom out under moderate loads and rarely if ever do so under extreme loads; the upper surface of the cushioning device remains suspended above the lower surface. In contrast, the new design in FIG. 9 provides firm support to foot support structures by providing for actual contact between the lower surface 165 of the upper midsole 147 and the upper surface 166 of the bottom sole 149 when fully loaded under moderate body weight pressure, as indicated in FIG. 9B, or under maximum normal peak landing force during running, as indicated in FIG. 9C, just as the human foot does in FIGS. 8B and 8C. The greater the downward force transmitted through the foot to the shoe, the greater the compression pressure in the cushioning compartment 161 and the greater the resulting tension of the shoe sole sides.

Figure 9D:
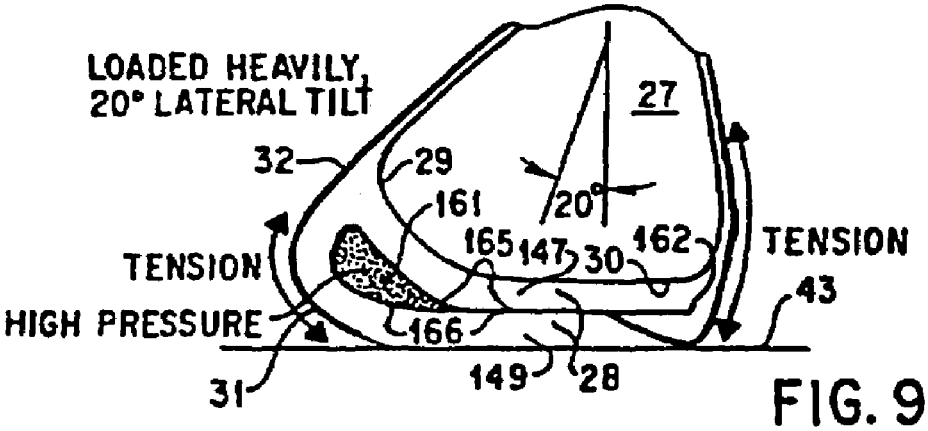

FIG. 9D shows the same shoe sole design when fully loaded and tilted to the natural 20 degree lateral limit, like FIG. 8D. FIG. 9D shows that an added stability benefit of the natural cushioning system for shoe soles is that the effective thickness of the shoe sole is reduced by compression on the side so that the potential destabilizing lever arm represented by the shoe sole thickness is also reduced, so foot and ankle stability is increased. Another benefit of the FIG. 9 design is that the upper midsole shoe surface can move in any horizontal direction, either sideways or front to back in order to absorb shearing forces; that shearing motion is controlled by tension in the sides. Note that the right side of FIGS. 9A–D is modified to provide a natural crease or upward taper 162, which allows complete side compression without binding or bunching between the upper and lower shoe sole layers 147, 148, and 149; the shoe sole crease 162 parallels exactly a similar crease or taper 163 in the human foot.

Another possible variation of joining shoe upper to shoe bottom sole is on the right (lateral) side of FIGS. 9A–D, which makes use of the fact that it is optimal for the tension absorbing shoe sole sides, whether shoe upper or bottom sole, to coincide with the Theoretically Ideal Stability Plane along the side of the shoe sole beyond that point reached when the shoe is tilted to the foot's natural limit, so that no destabilizing shoe sole lever arm is created when the shoe is tilted fully, as in FIG. 9D. The joint may be moved up slightly so that the fabric side does not come in contact with the ground, or it may be cover with a coating to provide both traction and fabric protection.

It should be noted that the FIG. 9 design provides a structural basis for the shoe sole to conform very easily to the natural shape of the human foot and to parallel easily the natural deformation flattening of the foot during load-bearing motion on the ground. This is true even if the shoe sole is made conventionally with a flat sole, as long as rigid structures such as heel counters and motion control devices are not used; though not optimal, such a conventional flat shoe made like FIG. 9 would provide the essential features of the new invention resulting in significantly improved cushioning and stability. The FIG. 9 design could also be applied to intermediate-shaped shoe soles that neither conform to the flat ground or the naturally contoured foot. In addition, the FIG. 9 design can be applied to the applicant's other designs, such as those described in his pending U.S. application Ser. No. 07/416,478, filed on Oct. 3, 1989.

In summary, the FIG. 9 design shows a shoe construction for a shoe, including: a shoe sole with a compartment or compartments under the structural elements of the human foot, including at least the heel; the compartment or compartments contains a pressure-transmitting medium like liquid, gas, or gel; a portion of the upper surface of the shoe sole compartment firmly contacts the lower surface of said compartment during normal load-bearing; and pressure from the load-bearing is transmitted progressively at least in part to the relatively inelastic sides, top and bottom of the shoe sole compartment or compartments, producing tension.

Figure 10A:
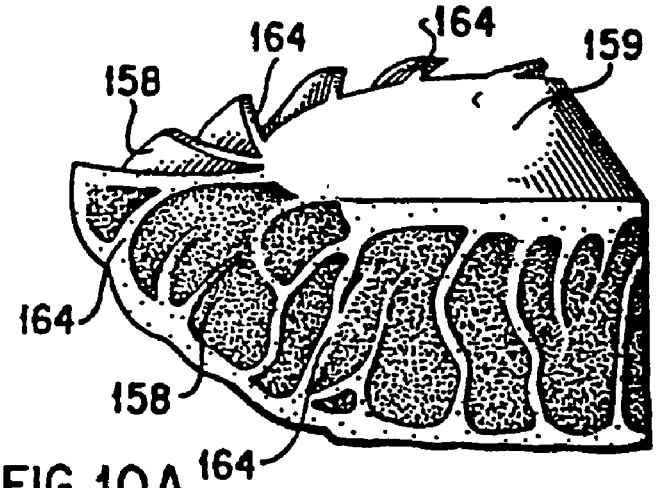
FIG. 10A shows a quartered section of the calcaneus and the fat pad chambers below it.
Figure 10B:
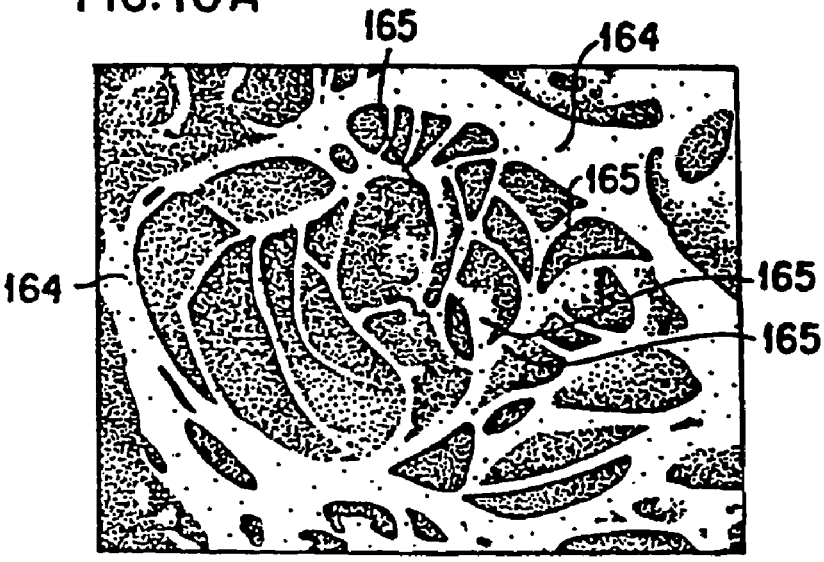
FIG. 10B shows a horizontal plane close-up of the inner structures of an individual chamber.
Figure 10C:
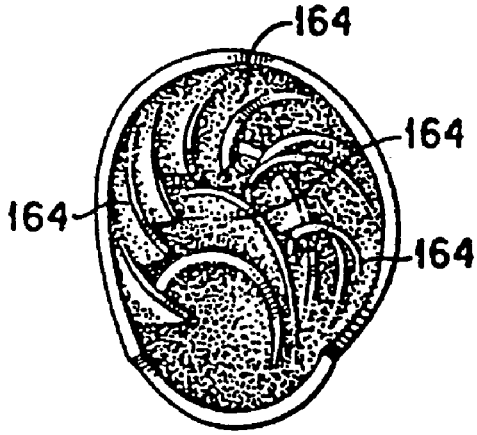
FIG. 10C shows a horizontal section of the whorl arrangement of fat pad underneath the calcaneus.

While the FIG. 9 design copies in a simplified way the macro structure of the foot, FIGS. 10A–C focus on a more on the exact detail of the natural structures, including at the micro level. FIGS. 10A and 10C are perspective views of cross sections of the human heel showing the matrix of elastic fibrous connective tissue arranged into chambers 164 holding closely packed fat cells; the chambers are structured as whorls radiating out from the calcaneus. These fibrous-tissue strands are firmly attached to the undersurface of the calcaneus and extend to the subcutaneous tissues. They are usually in the form of the letter U, with the open end of the U pointing toward the calcaneus.

As the most natural, an approximation of this specific chamber structure would appear to be the most optimal as an accurate model for the structure of the shoe sole cushioning compartments 161, at least in an ultimate sense, although the complicated nature of the design will require some time to overcome exact design and construction difficulties; however, the description of the structure of calcaneal padding provided by Erich Blechschmidt in Foot and Ankle, March, 1982, (translated from the original 1933 article in German) is so detailed and comprehensive that copying the same structure as a model in shoe sole design is not difficult technically, once the crucial connection is made that such copying of this natural system is necessary to overcome inherent weaknesses in the design of existing shoes. Other arrangements and orientations of the whorls are possible, but would probably be less optimal.

Pursuing this nearly exact design analogy, the lower surface 165 of the upper midsole 147 would correspond to the outer surface 167 of the calcaneus 159 and would be the origin of the U shaped whorl chambers 164 noted above.

FIG. 10B shows a close-up of the interior structure of the large chambers shown in FIGS. 10A and 10C. It is clear from the fine interior structure and compression characteristics of the mini-chambers 165 that those directly under the calcaneus become very hard quite easily, due to the high local pressure on them and the limited degree of their elasticity, so they are able to provide very firm support to the calcaneus or other bones of the foot sole; by being fairly inelastic, the compression forces on those compartments are dissipated to other areas of the network of fat pads under any given support structure of the foot, like the calcaneus. Consequently, if a cushioning compartment 161, such as the compartment under the heel shown in FIG. 9, is subdivided into smaller chambers, like those shown in FIG. 10, then actual contact between the upper surface 165 and the lower surface 166 would no longer be required to provide firm support, so long as those compartments and the pressure-transmitting medium contained in them have material characteristics similar to those of the foot, as described above; the use of gas may not be satisfactory in this approach, since its compressibility may not allow adequate firmness.

In summary, the FIG. 10 design shows a shoe construction including: a shoe sole with a compartments under the structural elements of the human foot, including at least the heel; the compartments containing a pressure-transmitting medium like liquid, gas, or gel; the compartments having a whorled structure like that of the fat pads of the human foot sole; load-bearing pressure being transmitted progressively at least in part to the relatively inelastic sides, top and bottom of the shoe sole compartments, producing tension therein; the elasticity of the material of the compartments and the pressure-transmitting medium are such that normal weight-bearing loads produce sufficient tension within the structure of the compartments to provide adequate structural rigidity to allow firm natural support to the foot structural elements, like that provided the barefoot by its fat pads. That shoe sole construction can have shoe sole compartments that are subdivided into micro chambers like those of the fat pads of the foot sole.

Since the bare foot that is never shod is protected by very hard callouses (called a "seri boot") which the shod foot lacks, it seems reasonable to infer that natural protection and shock absorption system of the shod foot is adversely affected by its unnaturally undeveloped fibrous capsules (surrounding the subcalcaneal and other fat pads under foot bone support structures). A solution would be to produce a shoe intended for use without socks (ie with smooth surfaces above the foot bottom sole) that uses insoles that coincide with the foot bottom sole, including its sides. The upper surface of those insoles, which would be in contact with the bottom sole of the foot (and its sides), would be coarse enough to stimulate the production of natural barefoot callouses. The insoles would be removable and available in different uniform grades of coarseness, as is sandpaper, so that the user can progress from finer grades to coarser grades as his foot soles toughen with use.

Similarly, socks could be produced to serve the same function, with the area of the sock that corresponds to the foot bottom sole (and sides of the bottom sole) made of a material coarse enough to stimulate the production of callouses on the bottom sole of the foot, with different grades of coarseness available, from fine to coarse, corresponding to feet from soft to naturally tough. Using a tube sock design with uniform coarseness, rather than conventional sock design assumed above, would allow the user to rotate the sock on his foot to eliminate any "hot spot" irritation points that might develop. Also, since the toes are most prone to blistering and the heel is most important in shock absorption, the toe area of the sock could be relatively less abrasive than the heel area.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side and a sole middle portion located between said sole sides;

a midsole component having an inner surface and an outer surface;

a bottom sole which forms at least part of the sole outer surface;

the shoe sole comprising a concavely rounded portion located between a concavely rounded portion of the inner surface of the midsole component and a concavely rounded portion of the sole outer surface, as viewed in a heel portion frontal plane cross-section when the shoe sole is upright and in an unloaded condition, the concavity of the concavely rounded portions of the inner surface of the midsole component and the sole outer surface existing with respect to an intended wearer's foot location inside the shoe;

at least a part of said concavely rounded portion of the shoe sole which extends through an arc of at least twenty degrees having a substantially uniform thickness, as viewed in a heel portion frontal plane cross-section, when the shoe sole is upright and in an unloaded condition;

at least one cushioning compartment located between the sole inner surface and the sole outer surface, as viewed in said heel portion frontal plane cross-section, and said at least one cushioning compartment including one of a gas, gel, or liquid.

2. The shoe according to claim 1, wherein the concavely rounded portion of the shoe sole extends substantially from above the sidemost extent of said sole outer surface of one sole side substantially to a sidemost extent of the sole outer surface of the other sole side, as viewed in said heel portion frontal plane cross-section when the shoe sole is upright and in an unloaded condition.

3. The shoe according to claim 1, wherein the concavely rounded portion of the shoe sole extends at least substantially from a height above the lowest point of the inner surface of the midsole component substantially to an uppermost point of said bottom sole portion on said sole side, as viewed in said heel portion frontal plane cross-section when the shoe sole is upright and in an unloaded condition.

4. The shoe according to claim 1, wherein the concavely rounded portion of the shoe sole extends substantially through a portion of the sole outer surface formed by the bottom sole portion, as viewed in said heel portion frontal plane cross-section when the shoe sole is upright and in an unloaded condition.

5. The shoe according to claim 1, wherein the sole has a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition; and the concavely rounded portion of the shoe sole extends substantially continuously to a boundary of the lateral sidemost section of the shoe sole, as viewed in a frontal plane cross-section when the shoe sole is upright and in an unloaded condition.

6. The shoe according to claim 1, wherein the sole has a medial sidemost section located outside a straight vertical line extending through the shoe sole at a medial sidemost extent of the inner surface of the midsole component, as viewed in said heel portion frontal plane cross-section when the shoe sole is upright and in an unloaded condition; and the concavely rounded portion of the shoe sole extends substantially continuously to a boundary of the medial sidemost section of the shoe sole, as viewed in a frontal plane cross-section when the shoe sole is upright and in an unloaded condition.

7. The shoe according to claim 1, wherein the sole has a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition;

the sole has a medial sidemost section located outside a straight vertical line extending through the shoe sole at a medial sidemost extent of the inner surface of the midsole component, as viewed in said heel portion frontal plane cross-section when the shoe sole is upright and in an unloaded condition; and the concavely rounded portion of the sole outer surface extends substantially continuously to both a boundary of the lateral sidemost section of the shoe sole, and a boundary of the medial sidemost section of the shoe sole, as viewed in a frontal plane cross-section when the shoe sole is upright and in an unloaded condition.

8. The shoe according to claim 1, wherein the concavely rounded portion of the shoe sole extends substantially to a lowest point of the sole outer surface, as viewed in a frontal plane cross-section when the shoe sole is upright and in an unloaded condition.

9. A shoe according to claim 1, wherein said concavely rounded portion of the shoe sole is located at said sole medial side, and said sole lateral side also includes a concavely rounded portion of the shoe sole extending at least from an uppermost point of a bottom sole portion substantially continuously through and above a sidemost extent of said sole outer surface, as viewed in said heel portion frontal plane cross-section when the shoe sole is upright and in an unloaded condition.

10. The shoe according to claim 1, wherein the concavely rounded portion of the shoe sole extends at least substantially from said lowest portion of the sole outer surface to a height above a lowest point of the inner surface of the midsole component, as viewed in said heel portion frontal plane cross-section when the shoe sole is upright and in an unloaded condition.

11. The shoe according to claim 1, wherein the concavely rounded portion of the shoe sole extends at least from said lowest portion of the sole outer surface substantially to a sidemost extent of said sole side, as viewed in said heel portion frontal plane cross-section when the shoe sole is upright and in an unloaded condition.

12. The shoe according to claim 1, wherein the concavely rounded portion of the shoe sole extends substantially from said sidemost extent of the sole outer surface of a sole side substantially to a sidemost extent of the sole outer surface of the other side, as viewed in said heel portion frontal plane cross-section when the shoe sole is upright and in an unloaded condition.

13. The shoe according to claim 1, wherein the concavely rounded portion of the shoe sole extends substantially from the sidemost extent of the sole outer surface of a sole side substantially through a sidemost extent of the sole outer surface of the other sole side, as viewed in said heel portion frontal plane cross-section when the shoe sole is upright and in an unloaded condition.

14. The shoe according to claim 1, wherein the concavely rounded portion of the shoe sole extends substantially through and beyond a midpoint of the shoe sole, as viewed in a frontal plane cross-section when the shoe sole is upright and in an unloaded condition.

15. The shoe according to claim 1, wherein the concavely rounded portion of the shoe sole extends from above a lowest point of an inner surface of said bottomsole substantially to a lowest point of the sole outer surface, as viewed in a frontal plane cross-section when the shoe sole is upright and in an unloaded condition.

16. The shoe according to claim 1, wherein the concavely rounded portion of said shoe sole is located below a height of a lowest point of the inner surface of the midsole component, as viewed in said heel portion frontal plane cross-section when the shoe sole is upright and in an unloaded condition.

17. The shoe according to claim 1, wherein the concavely rounded portion of the shoe sole extends down to at least an uppermost point of a bottom sole portion, as viewed in said heel portion frontal plane cross-section when the shoe sole is upright and in an unloaded condition.

18. The shoe according to claim 1, wherein the concavely rounded portion of the shoe sole extends substantially from a sidemost extent of the sole outer surface substantially to an uppermost point of said bottom sole portion, as viewed in said heel portion frontal plane cross-section when the shoe sole is upright and in an unloaded condition.

19. The shoe according to claim 1, wherein a part of the concavely rounded portion of the sole outer surface is formed by a bottomsole portion which extends into a sidemost section of at least one sole side, as viewed in said heel portion frontal plane cross-section when the shoe sole is upright and in an unloaded condition.

20. The shoe according to claim 1, wherein a part of the sole outer surface is formed by midsole extending up from the bottom sole portion, as viewed in said heel portion frontal plane cross-section when the shoe sole is upright and in an unloaded condition.

21. The shoe according to claim 1, wherein a part of the concavely rounded portion of the sole outer surface is formed by midsole, as viewed in said heel portion frontal plane cross-section when the shoe sole is upright and in an unloaded condition.

22. The shoe according to claim 1, wherein the outer surface of the midsole component comprises a concavely rounded portion, the concavity being determined relative to an inner section of the midsole component located directly adjacent to the concavely rounded outer surface portion of the midsole component, as viewed in a frontal plane cross-section when the shoe sole is upright and in an unloaded condition.

23. The shoe as claimed in claim 1, wherein the outer surface of the midsole component comprises a concavely rounded portion extending substantially through and beyond a lowest portion of the outer surface of the midsole component, as viewed in said frontal plane cross-section when the shoe sole is upright and in an unloaded condition, the concavity of the concavely rounded portion of the outer surface of the midsole component existing with respect to an inner section of the midsole component directly adjacent to the concavely rounded portion of the outer surface of the midsole component.

24. The shoe according to claim 1, wherein said at least one cushioning compartment is defined by an outer surface having a concavely rounded portion, as viewed in a frontal plane cross-section when the shoe sole is upright and in an unloaded condition, the concavity of the concavely rounded portion of the outer surface which defines the at least one cushioning compartment existing with respect to inside each respective cushioning compartment.

25. The shoe according to claim 24, wherein the cushioning compartment is encapsulated.

26. The shoe according to claim 1, wherein the outer surface which defines the at least one cushioning compartment comprises an upper surface portion and a lower surface portion, the upper and lower surface portions of said at least one cushioning compartment contacting when the shoe is fully loaded under moderate body weight pressure and when the shoe is subjected to maximum normal peak landing forces during running.

27. The shoe according to claim 1, wherein a top portion of the at least one cushioning compartment is bounded by midsole, as viewed in said frontal plane cross-section when the shoe sole is upright and in an unloaded condition.

28. The shoe according to claim 1, wherein a portion of a shoe upper of the shoe envelops on the outside a part of the midsole portion.

29. The shoe according to claim 1, wherein the shoe is an athletic shoe.

30. The shoe according to claim 1, wherein the sole has a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition;

the sole has a medial sidemost section located outside a straight vertical line extending through the shoe sole at a medial sidemost extent of the inner surface of the midsole component, as viewed in said heel portion frontal plane cross-section when the shoe sole is upright and in an unloaded condition; and a portion of the bottom sole and a portion of the midsole component extends into one of said sidemost sections of the shoe sole side, as viewed in said heel portion frontal plane cross-section when the shoe sole is upright and in an unloaded condition.

31. The shoe according to claim 30, wherein said midsole portion located in a sidemost section of the shoe sole extending to a height above a lowest point of said inner surface of the midsole component, as viewed in said heel portion frontal plane cross-section when the shoe sole is upright and in an unloaded condition.

32. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side and a sole middle portion located between said sole sides;

a midsole component having an inner surface and an outer surface;

a bottom sole which forms at least part of the sole outer surface;

the shoe sole comprising a concavely rounded portion located between a concavely rounded portion of the inner surface of the midsole component and a concavely rounded portion of the sole outer surface, as viewed in a heel portion frontal plane cross-section when the shoe sole is upright and in an unloaded condition, the concavity of the concavely rounded portions of the inner surface of the midsole component and the sole outer surface existing with respect to an intended wearer's foot location inside the shoe;

at least a part of said concavely rounded portion of the shoe sole located between said convexly rounded portion of the sole inner surface and said concavely rounded portion of the sole outer surface has a substantially uniform thickness extending from a location proximate to a sidemost extent of the shoe sole side to a lowest point on said sole side, as viewed in said heel portion frontal plane cross-section when the shoe sole is upright and in an unloaded condition; and at least one cushioning compartment located between the sole inner surface and the sole outer surface, as viewed in said heel portion frontal plane cross-section, and said at least one cushioning compartment including one of a gas, gel, or liquid.

33. A shoe sole as claimed in claim 32, wherein said shoe sole comprises at least two concavely rounded portions of the shoe sole located between said convexly rounded portion of the sole inner surface and each said concavely rounded portion of the sole outer surface has a substantially uniform thickness extending from a location proximate to a sidemost extent of the shoe sole side to a lowest point on said sole side, as viewed in said heel portion frontal plane cross-section when the shoe sole is upright and in an unloaded condition.

* * * * *